US005325978A

United States Patent [19]

Rabig

[11] Patent Number: 5,325,978

[45] Date of Patent: Jul. 5, 1994

[54] NESTING MAGAZINE ORGANIZER

[75] Inventor: Donald B. Rabig, Elizabeth, N.J.

[73] Assignee: Sterling Plastics Co., Mountainside, N.J.

[21] Appl. No.: 37,529

[22] Filed: Apr. 13, 1987

[51] Int. Cl.[5] ..... B65D 6/00

[52] U.S. Cl. ..... 220/4.24; 220/23.4; 220/23.6; 220/23.83; 206/45.11; 206/45.15

[58] Field of Search ..... 220/4.21, 4.29, 23.4, 220/23.6, 23.83; 206/45.11, 45.14, 45.15, 387, 449, 451

[56] References Cited

U.S. PATENT DOCUMENTS

| | | | |
|---|---|---|---|
| 776,042 | 11/1904 | Acheson | 206/45.11 |
| 2,487,168 | 11/1949 | Mordkin | 206/45.11 X |
| 2,604,959 | 7/1952 | Arbib | 206/45.11 X |
| 3,280,968 | 10/1966 | Craine | 206/45.11 |
| 3,670,872 | 6/1972 | Rock et al. | 220/4.24 X |
| 4,037,750 | 7/1977 | Box | 220/4.24 |
| 4,216,858 | 8/1980 | Beauchamp | 206/45.15 |
| 4,368,817 | 1/1983 | Temesvary | 206/387 X |
| 4,512,469 | 4/1985 | West | 206/387 |

*Primary Examiner*—Stephen P. Garbe
*Assistant Examiner*—Stephen Cronin
*Attorney, Agent, or Firm*—Baker & McKenzie

[57] ABSTRACT

A container for holding a plurality of magazines, includes a first side wall having a first bottom edge, a first rear edge, a first top edge and a first front edge; a second side wall having a second bottom edge, a second rear edge, a second top edge and a second front edge; a bottom wall connecting the first and second bottom edges of the first and second side walls together; a rear wall connecting the first and second rear edges of the first and second side walls together; the bottom wall and the rear wall maintaining the first and second side walls in substantially parallel, spaced apart relation; the first and second top edges of the first and second side walls being unconnected with each other; and the first and second front edges of the first and second side walls being unconnected with each other; wherein side walls of a first such container fits within side walls of a second such container with a friction fit.

8 Claims, 1 Drawing Sheet

NESTING MAGAZINE ORGANIZER

BACKGROUND OF THE INVENTION

This invention relates generally to magazine and paper holders and, more particularly, is directed to a nesting magazine organizer.

Open ended containers for holding and organizing magazines and other papers are well known. Such containers are formed with parallel, spaced apart side walls connected by a bottom wall, a rear wall, and either a front wall or a top wall. If a top wall is provided, access is attained through the front of the container, and if a front wall is provided, access is attained through the top of the container. The side walls have dimensions generally at least as great as the magazines to be received therebetween, and are made of a sturdy plastic, cardboard or like material.

As with most containers, a problem occurs during shipping of the containers. Specifically, because of the free space between the side walls, the containers occupy an undue amount of space when shipped. This results in an increase in the shipping cost of the same, particularly when shipping thousands of such containers.

U.S. Pat. No. 776,042 to Acheson discloses a packing and display box which is used for storing and displaying bluing devices in the form of sticks. The box is formed in two halves which are Joined together by nails during shipping and are separated into the two halves for display thereafter. The two halves can each be used for displaying the sticks. However, the two halves, when joined together, are flush with each other, thereby requiring the aforementioned nails to temporarily secure the two halves together during shipping.

U.S. Pat. No. 1,065,922 to Cutler discloses a receptacle formed of two halves which are hingedly connected to each other. However, only one of the halves is used for storing materials, and the other half is used as a cover.

German Offenlegungsscrift No. 1,486,241, which was filed on May 6, 1965 and published on May 29, 1969, discloses a packaging container of foam plastic, with a base and side walls designed so that containers can be stacked one on top of the other, and aligned with others alongside. The construction, however, requires a relatively complicated configuration, with edges thereof formed with a zig-zag type shape in order to intermesh with each other.

French Patent No. 1,253,068 discloses a container having two identical separable parts which are held together by tongue-type connectors. In this manner, the positioning of the tongues must be precise in order to obtain a secure fitting of the separable parts. The tongues therefore increase the manufacturing costs and complexity of the container.

Lastly, U.S. Pat. No. 3,952,903 to Sanders et al. discloses another container held together with snap fasteners.

OBJECTS AND SUMMARY OF THE INVENTION

Accordingly, it is an object of the present invention to provide a nesting magazine organizer in which two containers can be interfitted with each other in a friction fitting relation for compact and easy shipping.

It is another object of the present invention to provide a nesting magazine organizer in which the two containers need not be provided with any separate connecting means for interfitting them together.

It is still another object of the present invention to provide a nesting magazine organizer in which the two containers are formed with identical configurations.

It is yet another object of the present invention to provide a nesting magazine organizer in which each container is adapted to hold a plurality of magazines and other papers.

In accordance with an aspect of the present invention, a container for holding a plurality of magazines, includes a first side wall having a first bottom edge, a first rear edge, a first top edge and a first front edge; a second side wall having a second bottom edge, a second rear edge, a second top edge and a second front edge; a bottom wall connecting the first and second bottom edges of the first and second side walls together; a rear wall connecting the first and second rear edges of the first and second side walls together; the bottom wall and the rear wall maintaining the first and second side walls in substantially parallel, spaced apart relation; the first and second top edges of the first and second side walls being unconnected with each other; and the first and second front edges of the first and second side walls being unconnected with each other; wherein the first and second side walls of a first such container fits within the first and second side walls of a second such second container with a friction fit.

In accordance with another aspect of the present invention, a nesting magazine organizer includes:

(a) a first container for holding a plurality of magazines, the first container including:
  (i) a first side wall having a first bottom edge, a first rear edge, a first top edge and a first front edge;
  (ii) a second side wall having a second bottom edge, a second rear edge, a second top edge and a second front edge;
  (iii) a first bottom wall connecting the first and second bottom edges of the first and second side walls together;
  (iv) a first rear wall connecting the first and second rear edges of the first and second side walls together;
  (v) the first bottom wall and the first rear wall maintaining the first and second side walls in substantially parallel, spaced apart relation;
  (vi) the first and second top edges of the first and second side walls being unconnected with each other;
  (vii) the first and second front edges of the first and second side walls being unconnected with each other;

(b) a second container for holding a plurality of magazines, the second container including:
  (i) a third side wall having a third bottom edge, a third rear edge, a third top edge and a third front edge;
  (ii) a fourth side wall having a fourth bottom edge, a fourth rear edge, a fourth top edge and a fourth front edge;
  (iii) a second bottom wall connecting the third and fourth bottom edges of the third and fourth side walls together;
  (iv) a second rear wall connecting the third and fourth rear edges of the third and fourth side walls together;

(v) the second bottom wall and the second rear wall maintaining the third and fourth side walls in substantially parallel, spaced apart relation;

(vi) the third and fourth top edges of the third and fourth side walls being unconnected with each other; and (vii) the third and fourth front edges of the third and fourth side walls being unconnected with each other; and (c) the first and second side walls of the first container fitting within the third and fourth side walls of the second container with a friction fit.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
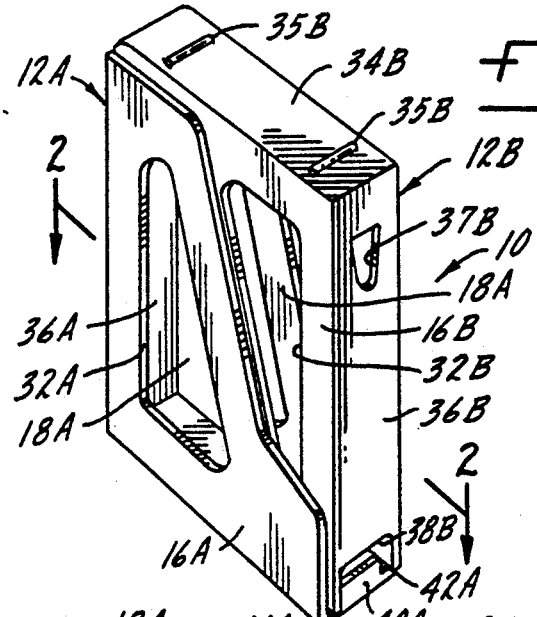
FIG. 1 is a perspective view of the nesting magazine organizer according to the present invention in a condition for shipping.
Figure 2:
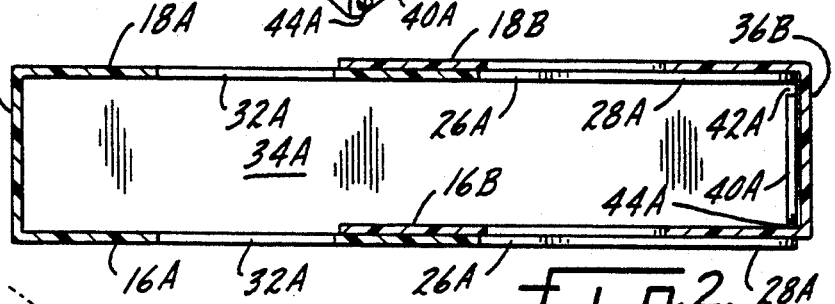
FIG. 2 is a cross-sectional view of the nesting magazine organizer of FIG. 1, taken along line 2—2 thereof.
Figure 3:
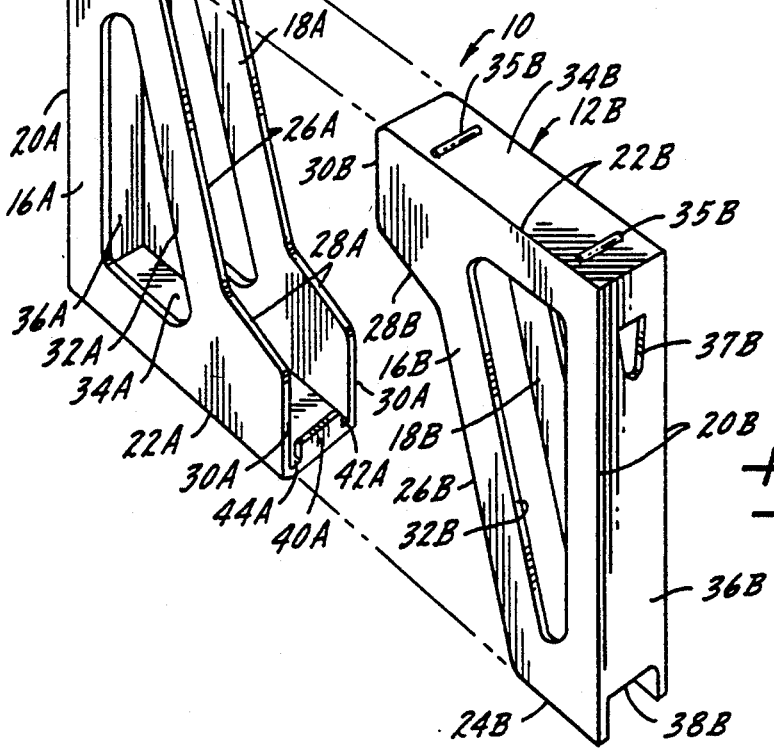
FIG. 3 is a perspective view of the two containers of the nesting magazine organizer of FIG. 1 separated from each other.

Referring to the drawings in detail, a nesting magazine organizer 10 according to the present invention includes two containers 12A and 12B, each constructed to hold a plurality of magazines and other papers (not shown). Both containers 12A and 12B are constructed in an identical manner, and accordingly, a detailed description of only one container will be given, with the understanding that the reference numerals used to describe such container have an A or a B added thereto in the drawings, depending upon which container 12A or 12B is shown.

Container 12 includes two parallel, spaced apart side walls 16 and 18 which are constructed in an identical manner, and accordingly, only one side wall 16 will be described. Side wall 16 has a height at a rear edge 20 thereof, generally at least as great as the height of magazines to be held therein. Side wall 16 also has a width along a bottom edge 22 thereof which extends forwardly a sufficient distance that is generally at least as great as the width of the magazines to be contained in container 12, bottom edge 22 being substantially perpendicular to rear edge 20. The top edge 24 of side wall 16 extends from rear edge 20, but only for a small distance which is much less than the length of bottom edge 22, and which is preferably parallel to bottom edge 22.

The front edge of side wall 16 which connects the forwardmost portions of bottom edge 22 and top edge 24 is preferably formed in three edge sections 26, 28 and 30. Specifically, edge section 26 extends downwardly from the forwardmost portion of top edge 24 at an angle of approximately 110 degrees with respect thereto. Edge section 28 extends downwardly from the lowermost portion of edge section 26 at an angle of approximately 125 degrees with respect thereto, and edge section 30 extends downwardly from the lowermost portion of edge section 28 in substantially parallel relation to rear edge 20 and meets with the forwardmost portion of bottom edge 22.

As shown, side wall 16 is cut-out, as at 32, in order to reduce the materials used in formation of the container, without affecting its performance. Cut-out section 32 should not be too large, since its performance may be affected, that is, the magazines may fall out through cut-out section 32. In the embodiment shown, cut-out section 32 if formed in a triangular configuration, although the present invention is not limited thereby.

Container 12 Includes a bottom wall 34 which connects bottom edges 22 of side walls 16 and 18 together to maintain the same in the aforementioned parallel, spaced apart relation. Bottom wall 34 is preferably formed with linear raised projections 35 extending thereacross, for supporting container 12 on a flat surface, without damaging such surface.

In addition, container 12 includes a rear wall 36 which connects rear edges 20 of side walls 16 and 18 together to maintain the same in the aforementioned parallel, spaced apart relation. Rear wall 36 has a height less than that of rear edges 20, whereby a U-shaped recess 38 is defined at the upper rear portion of container 12 by the upper edge of rear wall 36 and the portions of rear edges 20 extending thereabove. This aids in the nesting of containers 12A and 12B within each other, as will be explained in greater detail hereinafter. In addition, rear wall 36 includes a small cut-out 37 at the lower portion thereof, to aid the user in carrying container 12 and removing container 12A from container 12B.

An upwardly extending tab 40 is formed at the forwardmost portion of bottom wall 34 between front edges 30, and extends upwardly a distance which is not greater than the height of recess 38. The width of tab 40 is less than that of bottom wall 34, so that there is a small space at opposite sides of tab 40, that is, between tab 40 and side walls 16 and 18, so as to define grooves 42 and 44. This construction cooperates with recess 38 so as to aid in the nesting of containers 12A and 12B within each other, as will be explained in greater detail hereinafter.

Preferably, side walls 16 and 18 are constructed from a resilient plastic material, cardboard or the like. It will be appreciated from the above that side walls 16 and 18 are not connected together at top edges 24 and the front edges thereof defined by edge sections 26, 28 and 30. Accordingly, side walls 16 and 18 can be flexed slightly toward and away from each other, but when the external force is removed, side walls 16 and 18 will return to their original parallel, spaced apart configuration.

In order to reduce the space required when shipping containers 12A and 12B, the containers are nested within each other, as shown in FIG. 1. Specifically, container 12B is first inverted with respect to container 12A. Then, side walls 16B and 18B of container 12B are forced slightly toward each other, and inserted in the space between side walls 16A and 18A of container 12A, the latter side walls 16A and 18A being thereby forced apart slightly. This creates a friction fit which securely holds containers 12A and 12B in this relationship for condensed shipping.

In addition, the upper portions of rear edges 20B of container 12B which define recess 38B, fit within grooves 42A and 44A defined between tab 40A and side walls 16A and 18A. Accordingly, side walls 16B and 18B are deformed slightly toward each other when fit within grooves 42A and 44A. This provides a further fiction fit.

It will therefore be appreciated that containers 12A and 12B of nesting magazine organizer 10 can be interfitted with each other in a friction fitting relation for easy shipping, without any separate connecting means being provided for interfitting them together. Still further, containers 12A and 12B are formed with identical configurations, which does not require any additional tooling.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined in the appended claims.

What is claimed is:

1. A nesting container assembly for holding a plurality of magazines, comprising:

a first container having a first side wall having a first bottom edge, a first rear edge, a first top edge and a first front edge;

a second side wall having a second bottom edge, a second rear edge, a second top edge and a second front edge;

a bottom wall connecting said first and second bottom edges of said first and second side walls together;

a rear wall connecting said first and second rear edges of said first and second side walls together;

said rear wall has a height less than that of said first and second rear edges so as to define a recess;

said bottom wall and said rear wall maintaining said first and second side walls in substantially parallel, spaced apart relation;

said first and second top edges of said first and second side walls being unconnected with each other;

said first and second front edges of said first and second side walls being unconnected with each other;

said first container further including an upstanding tab connected to said bottom wall between said first and second front edges and having a width less than that of said bottom wall to define first and second grooves between said tab and said first and second front edges;

a second container having the above described components;

said first and second side walls of said first container fits within said first and second side walls of said second container with a friction fit;

said first and second top edges of said first and second side walls of said first container being accommodated in said first and second grooves and said second container;

said first and second top edges of said first and second side walls of said second container being accommodated in said first and second grooves of said first container;

said tab of said first container being accommodated in said recess of said second container;

said tab of said second container being accommodated in said recess of said first container;

whereby said first container is accommodated in an inverted position within said second container with a friction fit.

2. A nesting container assembly according to claim 1; wherein said first and second side walls are each provided with cut-out sections.

3. The nesting container assembly of claim 1, wherein said rear walls of each of said first and second containers include a cut-out to facilitate separation of said first and second containers after friction fitting of said first and second containers.

4. A nesting magazine organizer, comprising:

(a) a first container for holding a plurality of magazines, said first container including;

(i) a first side wall having a first bottom edge, a first rear edge, a first top edge and a first front edge;

(ii) a second side wall having a second bottom edge, a second rear edge, a second top edge and a second front edge;

(iii) a first bottom wall connected said first and second bottom edges of said first and second side walls together;

(iv) a first rear wall connecting said first and second rear edges of said first and second side wall together;

(v) said first bottom wall and said first rear wall maintaining said first and second side walls in substantially parallel, spaced apart relation;

(vi) said first and second top edges of said first and second side walls being unconnected with each other, said first and second top edges of said first and second side walls being unconnected to said first rear wall; and (vii) said first and second front edges of said first and second side walls being unconnected with each other;

(b) a second container for holding a plurality of magazines, said second container including:

(i) a third side wall having a third bottom edge, a third rear edge, a third top edge and a third front edge;

(ii) a fourth side wall having fourth bottom edge, a fourth rear edge, a fourth top edge and a fourth front edge;

(iii) a second bottom wall connecting said third and fourth bottom edges of said third and fourth side walls together;

(iv) a second rear wall connecting said third and fourth rear edges of said third and fourth side walls together;

(v) said second bottom wall and said second rear wall maintaining said third and fourth side walls in substantially parallel, spaced apart relation;

(vi) said third and fourth top edges of said third and fourth side walls being unconnected with each other, said third and fourth top edges of said third and fourth top walls being unconnected to said second rear wall;

(vii) said third and fourth front edges of said third and fourth side walls being unconnected with each other;

(c) said first and second side walls of said first container fitting within said third and fourth side walls of said second container with a friction fit, said first and second containers being of the same size.

5. A nesting magazine organizer according to claim 4; wherein said first rear wall has a height less than that of said first and second rear edges so as to define a first recess, and said second rear wall has a height less than that of said third and fourth rear edges so as to define a second recess.

6. A nesting magazine organizer according to claim 5; wherein said first container further includes a first upstanding tab connected to said first bottom wall between said first and second front edges and having a width less than that of said first bottom wall to define first and second grooves between said first tab and said first and second front edges, and said second container further includes a second upstanding tab connected to said second bottom wall between said third and fourth front edges and having a width less than that of said second bottom wall to define third and fourth grooves between said second tab and said third and fourth front edges.

7. The nesting magazine organizer of claim 4, wherein said rear walls of each of said first and second containers include a cut-out to facilitate separation of said first and second containers after friction fitting of said first and second containers.

8. A nesting magazine organizer according to claim 4; wherein said first through fourth side walls are each provided with cut-out sections.

* * * * *